US006893112B2

(12) United States Patent
Howkins et al.

(10) Patent No.: US 6,893,112 B2
(45) Date of Patent: May 17, 2005

(54) STRUCTURALLY ISOLATED INERTIAL TRANSDUCERS FOR A PRINTING SYSTEM

(75) Inventors: Stuart D. Howkins, Ridgefield, CT (US); Charles A. Willus, Newton, CT (US)

(73) Assignee: Ricoh Printing Systems America, Inc., Simi Valley, CA (US)

( * ) Notice: Subject to any disclaimer, the term of this patent is extended or adjusted under 35 U.S.C. 154(b) by 36 days.

(21) Appl. No.: 10/376,850

(22) Filed: Feb. 28, 2003

(65) Prior Publication Data

US 2004/0169703 A1 Sep. 2, 2004

(51) Int. Cl.[7] ..... B41J 2/045
(52) U.S. Cl. ..... 347/40; 347/70
(58) Field of Search ..... 347/40, 68, 70

(56) References Cited

U.S. PATENT DOCUMENTS 4,439,780 A * 3/1984 DeYoung et al. ..... 347/68
4,788,557 A * 11/1988 Howkins ..... 347/68
5,510,816 A * 4/1996 Hosono et al. ..... 347/10
6,183,072 B1 * 2/2001 Altendorf ..... 347/85

* cited by examiner

*Primary Examiner*—Lamson Nguyen
*Assistant Examiner*—Blaise Mouttet
(74) *Attorney, Agent, or Firm*—Pillsbury Winthrop Shaw Pittman LLP

(57) ABSTRACT

A piezo-electric inkjet printing system includes an array of transducers. The array includes at least a first transducer and a second transducer. The first transducer is coupled to a first foot, and elongates in response to a first stimulus, causing ink to eject from a first ink chamber. The second transducer is coupled to a second foot, and elongates in response to a second stimulus, causing ink to eject from a second ink chamber. The first transducer is mechanically isolated from the second transducer.

32 Claims, 7 Drawing Sheets

STRUCTURALLY ISOLATED INERTIAL TRANSDUCERS FOR A PRINTING SYSTEM

BACKGROUND OF THE INVENTION

1. Technical Field

Embodiments of the present invention relate to the field of piezo-electric transducers in ink jet printers.

2. Description of the Related Arts

There are ink jet printers in the art. FIG. 1A illustrates a common mechanical structure of a length expander piezo-electric ink jet according to the prior art. As illustrated, a piezo-electric driver (e.g., transducer A 105, transducer B 110, transducer C 115, transducer D 120, transducer E 125, transducer F 130, and transducer G 135) exists for each separate channel. The transducers are not mechanically isolated from each other. Each of the transducers is in communication with the same mechanical transducer support structure 100. When a voltage is applied to a transducer or an existing voltage is rapidly changed, the transducer "fires" (i.e., rapidly elongates), extending in a direction opposite the mechanical transducer support structure 100.

When one of the transducers is fired, its motion is coupled mechanically to all of the other transducers. This results in "structural crosstalk." Crosstalk is a change in velocity and volume of an ejected drop of ink caused by the simultaneous (or prior firing) firing of one or more other channels. Crosstalk can result in degradation of print quality. The changes in drop velocity and size can be positive or negative. However, the crosstalk between adjacent channels is often negative.

FIG. 1B illustrates a common mechanical structure of a length expander piezo-electric ink jet after a transducer is fired according to the prior art. The reason for negative crosstalk between adjacent channels is illustrated by considering the common mechanical "rear mount" (i.e., the mechanical transducer support structure 100) for the transducers as a beam. When one transducer is fired, it extends in length to push against an ink chamber which reduces the volume of the chamber in order to expel a drop of ink. This length extension also results in a reaction force in the opposite direction on the mounting beam. The beam is therefore pushed away from the ink chambers and thus the adjacent transducers are also pulled away from their ink chambers as shown in FIG. 1B.

As illustrated, when transducer D 120 is fired, it expands in length and its lower end is initially displaced in a downward direction to drive an ink drop out of the chamber. The other end, however, is displaced in the opposite direction, pushing against the mechanical transducer support structure 100, causing it to deform. This deformation is propagated as a mechanical wave in the structure and the structure undergoes a damped vibration. The mechanical transducer support structure 100 necessarily deforms, as it is not possible to make it completely rigid. The adjacent transducers A 105, B 110, C 115, E 125, F 130, and G 135 are also pulled upward initially because they are also attached to the mechanical transducer support structure 100. If any of the adjacent transducers are fired at the same time as D 120, the initial upward motion will subtract from the firing motion, resulting in a smaller push on the chamber, resulting in a slower, smaller drop; thus, negative crosstalk. A similar explanation applies to the refill part of the drive pulse.

An additional deficiency results from use of the common support structure. The support structure is part of a housing connecting the beam on which the transducer is mounted to the fluid parts of the inkjet which, in turn, are connected to the other ends of the transducers. In general, the thermal coefficient of expansion of the transducers differs from that of the support structure. Temperature changes therefore can result in stresses which change the performance characteristics of the jets. These stresses and, consequently, the performance changes vary according to the location of a transducer in the array of transducers being fired.

Accordingly, current piezo-electric inkjet printing systems are deficient because the transducers are coupled to a common support structure, resulting in negative crosstalk between transducers. The common structure can also cause variations in performance due to temperature changes.

DETAILED DESCRIPTION

Figure 1A:
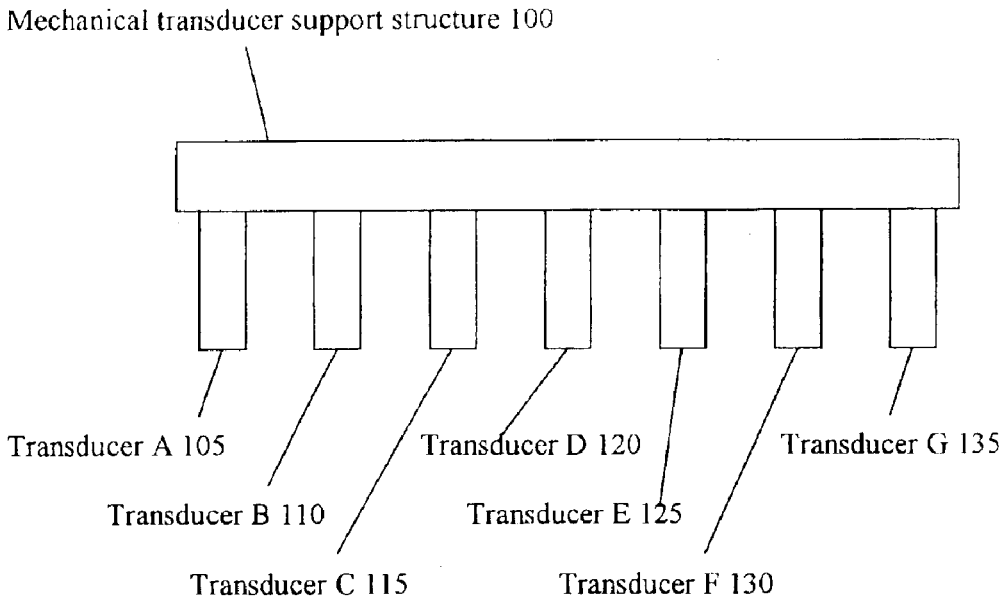
FIG. 1A Prior Art
FIG. 1A illustrates a common mechanical structure of a length expander piezo-electric ink jet according to the prior art.
Figure 1B:
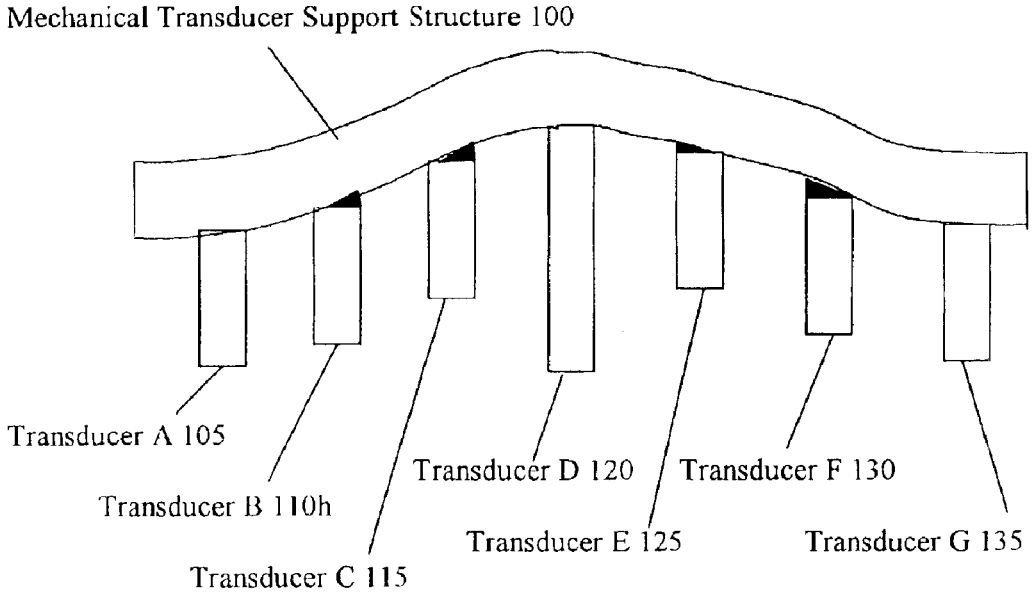
FIG. 1B Prior Art
FIG. 1B illustrates a common mechanical structure of a length expander piezo-electric ink jet after a transducer is fired according to the prior art.

Embodiments of the invention are directed to a piezo-electric inkjet printer. The piezo-electric inkjet printer may include an array of piezo-electric transducers, each of which may rapidly elongate when a voltage is applied thereto or a voltage already applied is rapidly changed. For a piezo-electric length expander design (i.e., a piezo-electric transducer which elongates when a voltage is applied thereto), the piezo-electric transducers are sometimes in the form of a rod or stick in which the motion in the length direction is the motion directly into an ink chamber coupled thereto. When the transducer expands or contracts, its other dimensions also change and the transducer undergoes a damped oscillatory motion in all dimensions following the primary change in length. In other words, when fired, a transducer elongates, then slightly shortens, then slightly further elongates, etc., during the firing. After the transducer has fired, it returns to its normal length and thickness. The oscillation frequency may be dependent upon the type of material forming the transducer, as well as the size, shape, and other physical properties of the mass coupled thereto. In general, coupling a mass to the transducer reduces the oscillation frequencies.

If the transducer's length is much greater than the other two dimensions, the frequency of this oscillatory motion is primarily determined by its length. This "fundamental length mode" resonance increases when the transducer is made smaller. It is also dependent upon the way in which the transducer is mounted. For example, a transducer which is not attached to anything at the end which is opposite a diaphragm coupled thereto, may have a fundamental length mode frequency which is about double that of an identical transducer mounted rigidly to a rigid structure.

There are also other simultaneous vibrations in the transducer. These may be higher harmonics of the length mode in addition to other modes and their harmonics. For long rods, the length mode harmonics and other modes may have an amplitude which is very small and/or a frequency which is very high, so they may be neglected. However, the fundamental length mode resonance may play an important role in the performance of the ink jet. For example, it may affect the drop size, the maximum repetition rate for jetting, drop shape, as well as many other important characteristics. For some applications, it has been advantageous to make the rods shorter. Sometimes, but not always, this has been achieved by using piezo-electric transducers made of many laminated layers. These transducers are sometimes referred to as "stacks." For short transducers, the length may not be large compared with at least one of the other two dimensions and the length mode may be coupled more strongly into other modes, resulting in a more complex vibration.

An embodiment of the present invention is directed toward both the longer rod or "stick" transducers as well as the shorter transducers which may have a shape similar to a rectangular plate with one of the edges driving the ink chamber.

To reduce crosstalk between the transducers when one of the transducers fires, each of the transducers may be structurally isolated from each other. The array of transducers may be formed so that when one of the transducers rapidly expands when fired, it does not push against a common structure mechanically coupled to other transducers. Accordingly, since each of the transducers are structurally isolated, crosstalk between transducers is reduced. Performance changes caused by temperature changes may also be reduced. Rather than push against a common structure, each of the transducers may be coupled directly to a mass (a different one for each transducer). When a transducer fires, it expands in its length-wise direction. In order to ensure that the transducer expands into an ink chamber so that ink may be forced from the ink jet onto a piece of paper, for example, the mass may be coupled to the end of a transducer that is opposite the end expanding into the ink chamber. Accordingly, when the transducer fires, even though the transducer extends up and down, the mass helps to ensure that the transducer extends far enough down into the ink chamber to force the ink out onto the paper. By coupling a mass to each of the transducers, the transducers need not push against a common support structure. Instead, a transducer that is fired may push against the mass coupled thereto, to allow the transducer to extend into the ink reservoir, without causing the push against the mass to affect the other transducers and result in faulty operation. In an alternative embodiment, the transducers may be designed to push against their own inertia so that a mass need not be coupled to the ends of the transducers. This may be advantageous in some ink jetting applications because, in the absence of a support structure, the mass plays an important role in determining the modes of vibration and their frequencies. As discussed above, this plays an important role in determining the performance characteristics of the jet. In general, a smaller mass may lead to higher resonant frequencies but to a smaller displacement amplitude at the diaphragm which may be advantageous for some applications for which higher drive voltages are not a major disadvantage.

Complex transducer motion is coupled into a fluidic system also having several resonances, and this is followed by the complex dynamics of an ink droplet in flight. A determination of the optimum mass to be used, is thus dependent on not only the details of the transducer dimensions but also upon the parameters of the fluidic section, the ink properties and the performance design objectives. The optimum mass therefore may be determined by a computer calculation using a mathematical model of the jet. The optimum mass may vary, and may be zero in some cases.

If the optimum mass is calculated to be large, then it may also be advantageous to keep the physical dimensions of the mass as small as possible. When the physical dimensions of the mass are larger, the resonant frequencies of the mass itself may be lower and coupled with the resonant frequencies of the transducer. The physical dimensions of a given mass may be minimized by making the mass from the densest material available. Some examples of suitable dense materials include, e.g., iridium, platinum, tungsten, and gold. In many cases, however, there may be no need to use such dense materials, and other materials such as copper, steel, or any other convenient materials easily attachable to the transducer may be used.

Figure 2A:
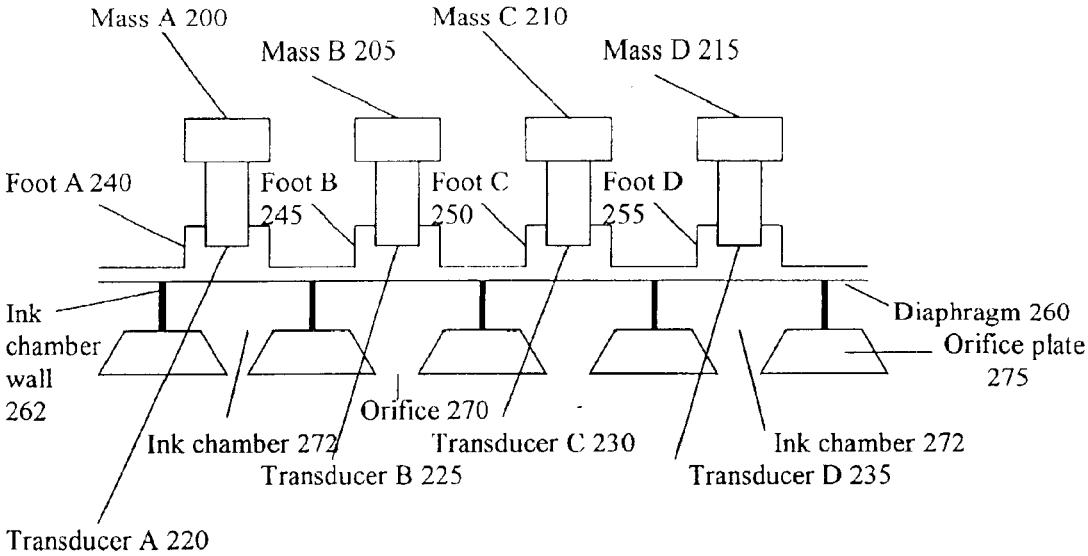
FIG. 2A illustrates an array of short piezo-electric transducers of an inkjet according to an embodiment of the invention.

FIG. 2A illustrates an array of piezo-electric transducers (A 220, B 225, C 230, and D 235) of an inkjet according to an embodiment of the invention. As shown, transducer A 220 is coupled on its top side to mass A 200. Mass A 200 may be formed of a more or less dense material such as described above, for example. Transducer A 220 may be a piezo-electric transducer that elongates in its length-wise direction when a voltage is applied thereto. Transducer A 220 may be formed of lead zircanate titanate, for example. Transducer A 220 may be coupled on its bottom end to foot A 240. When transducer A 220 fires, transducer A 220 lengthens, pushing up against mass A 200 and down against foot A 240. When one of the transducers (e.g., A 220, B 225, C 230, and D 235) fires, it physically elongates and become thinner (i.e., its two width dimensions decrease).

Mass A 200 is coupled to transducer A 220 so that when transducer A 220 fires, transducer A 220 extends up against the mass, but due to the massiveness of mass A, transducer A 220 extends further down, pushing further against foot A 240 than it would if mass A 200 were not utilized. Therefore, mass A 200 is utilized to push the transducer A 220 down. Because mass A 200 is present, a lower drive voltage may be applied to transducer A 220. In other words, if mass A 200 were absent, a larger drive voltage would have to be applied to transducer A 220 for transducer A 220 to do its job and push sufficiently against foot A 240.

When foot A 240 is pushed downward by transducer A 220, it is pushed against diaphragm 260, causing the portion of diaphragm 260 below foot A 240 to deform in a downward direction. Other embodiments may utilize the array of transducers without the diaphragm 260. In embodiments having no diaphragm 260, an elastomer may be utilized to prevent ink from leaking out by a foot, such as foot A 240.

Referring to FIG. 2A, an ink chamber 272 may located below the diaphragm 260. The ink chamber 272 is sandwiched between the diaphragm 260 and ink chamber walls 262. FIG. 2A also illustrates five ink chamber walls 262. When transducer A 220 fires, transducer A 220 elongates, pushing down foot A 240, and deforming the portion of diaphragm 260 below foot A 240. As the diaphragm 260 deforms, ink from the ink chamber 272 is forced out of an orifice 270 located in an orifice plate 275 below transducer A 220 and foot A 240. Although the orifices 270 in orifice plate 275 are shown as having a tapered structure, tapering down in a direction toward the exit of each orifice 270, the orifices 270 need not have such a tapered structure. In other words, the structure of the orifice plate 275 may be application-specific.

Transducer B 225 may be coupled to mass B 205 and foot B 245. Transducer C 230 may be coupled to mass C 210 and foot C 250. Transducer D 235 may be coupled to foot D 255 and mass D 215. Accordingly, to expel ink from a particular orifice 270, a voltage may be applied to the transducer located directly above the orifice 270, causing the transducer to elongate and push down its corresponding foot, deforming the diaphragm 260, and pushing ink out of the particular orifice 270.

Figure 2B:
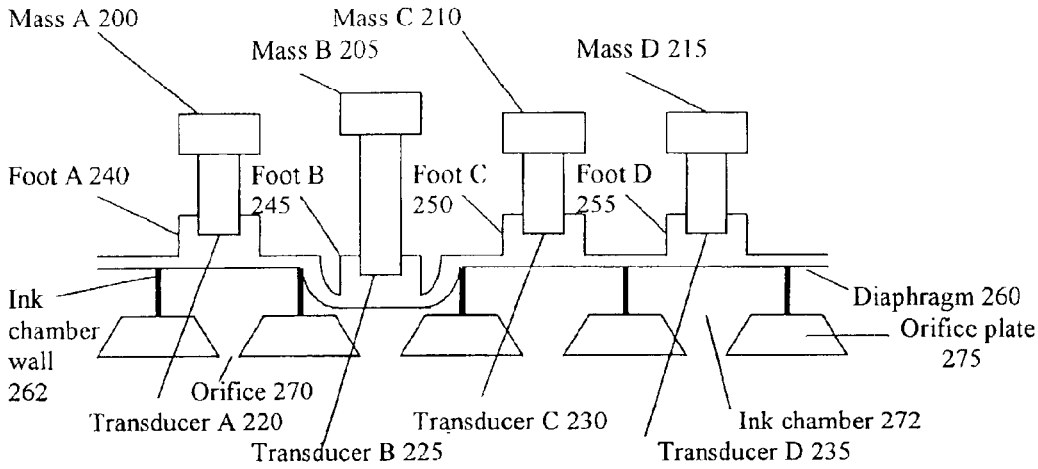
FIG. 2B illustrates an array of short piezo-electric transducers of an inkjet after a transducer is fired according to an embodiment of the invention.

FIG. 2B illustrates an array of piezo-electric transducers of an inkjet after a transducer is fired according to an embodiment of the invention. As shown, transducer B 225 has been fired. When transducer B 225 is fired, it elongates, pushing up against mass B 205, and down against the diaphragm 260, causing the diaphragm 260 to deform. When the diaphragm 260 deforms downward, an ink droplet is forced from the ink chamber down out of the orifice 270 of the orifice plate 275 below transducer B 225.

As illustrated, the elongation of transducer B 225 has a negligible effect on the other transducers (i.e., A 225, C 230, and D 235) in the transducer array. Specifically, when transducer B 225 fires and pushes against mass B 205, mass B 205 slightly moves in an upward direction. However, mass B's 205 upward movement does not cause masses A 200, C 210, or D 215 to also move up. This is because mass B 205 is physically isolated from masses A 200, C 210, or D 215. Accordingly, there is little, if any structural cross talk between transducers A 220, B 225, C 230, and D 235 when one of them is fired.

After the ink droplet is forced out of an orifice 270 due to the deformation of the diaphragm 260, the diaphragm 260 reverts to its starting position as the transducer shortens to its normal size. When the diaphragm 260 reverts to its normal position, a suction is created that brings more ink into the ink chamber 272 from a reservoir (not shown) coupled thereto. Accordingly, movement of the diaphragm 260 controls flow of ink into and out of the ink chamber 272. That is, when the diaphragm 260 is deformed down, toward an orifice 270, ink is forced out of the orifice 270, and when the diaphragm 260 reverts to its normal position, it reduces the pressure to pull ink from the reservoir to fill up the ink chamber 272.

Figure 2C:
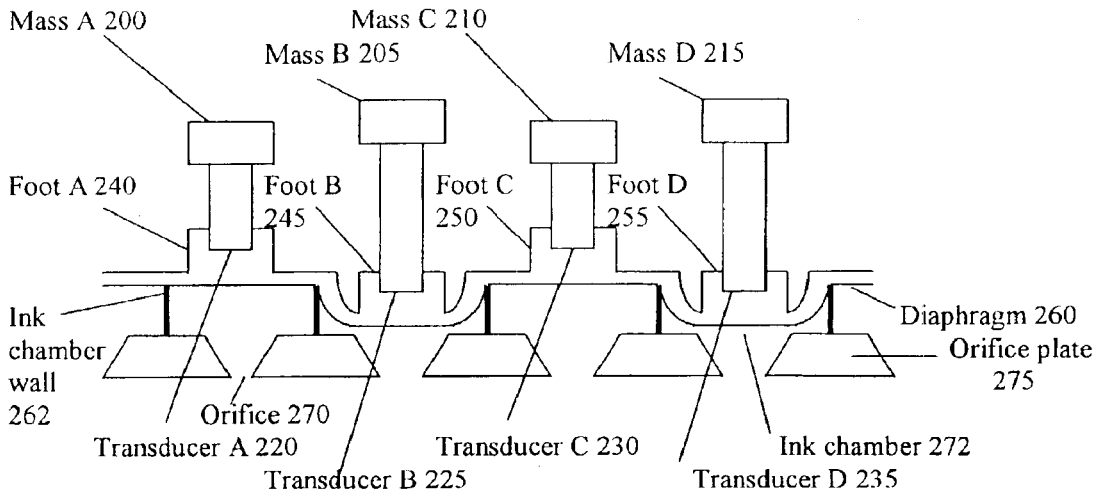
FIG. 2C illustrates an array of short piezo-electric transducers of an inkjet after two transducers have fired according to an embodiment of the invention.

FIG. 2C illustrates an array of piezo-electric transducers of an inkjet after two transducers have fired according to an embodiment of the invention. As shown, both transducer B 225 and D 235 have fired, resulting in the portion of the diaphragm 260 beneath them becoming deformed. As the diaphragm 260 becomes deformed, ink is forced out of the ink chamber 272 through the orifice 270 below transducer B 225 and the orifice 270 below transducer D 235. When transducers B 225 and D 260 revert to their normal sizes, diaphragm 260 may revert to its resting shape. As the diaphragm 260 reverts to its resting shape, ink from the reservoir may be pulled back into the ink chambers 272. As FIG. 2C illustrates, the firing of transducer B 225 has little, if any, effect on the firing of transducer D 235. Accordingly, because transducers B 225 and D 235 push against their respective masses (i.e., mass B 205 and mass D 215) rather than a common mechanical support structure as in prior systems, any crosstalk between transducers B 225 and D 235 is effectively minimized.

The transducers (e.g., A 220, B 225, C 230, and D 235) shown in FIGS. 2A–2C are known as rod or stick transducers. The mechanical stability of stick transducers may be dependent upon their lengths and widths. Shorter, wider stick transducers may be mechanically more stable than longer and narrower stick transducers, and may need only to be coupled to the diaphragm 260 at their feet (e.g., 240, 245, 250, and 255, respectively).

Figure 3:
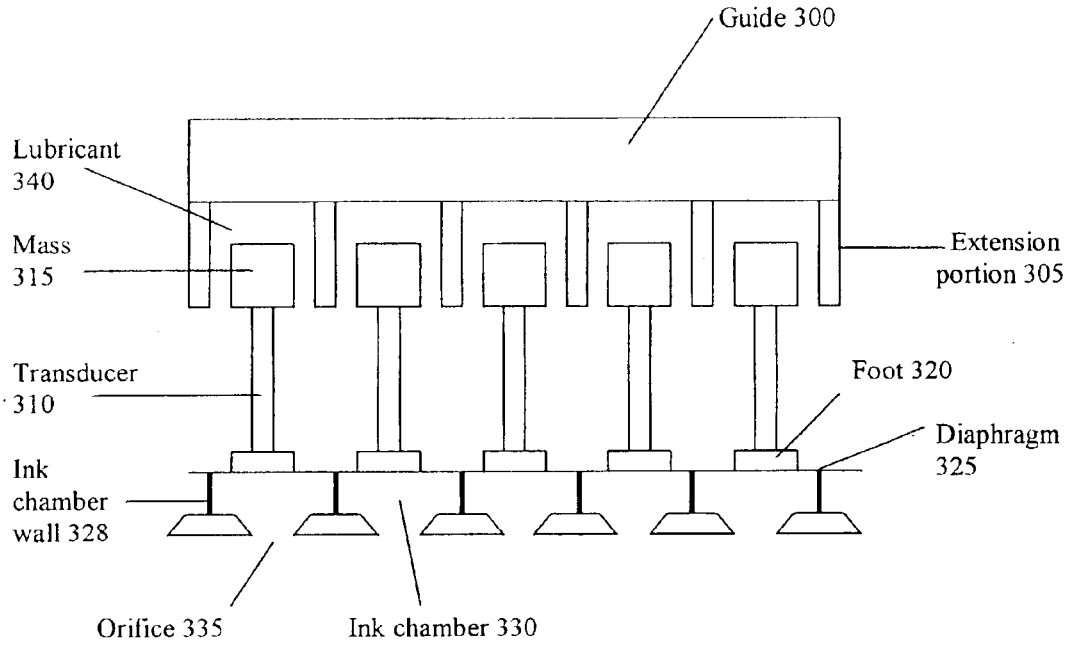
FIG. 3 illustrates an array of long piezo-electric transducers of an inkjet according to an embodiment of the invention.

FIG. 3 illustrates an array of long stick piezo-electric transducers 310 of an inkjet according to an embodiment of the invention. As shown, the long stick piezo-electric transducers 310 have a longer length than the short stack transducers as shown in FIGS. 2A–C. Because the long stick piezo-electric transducers 310 are relatively longer, they are also less mechanically stable. Specifically, when a long stick piezo-electric transducer 310 fires, it is important that the transducer extend directly downward in a direction perpendicular to the diaphragm. Accordingly, the long stick piezo-electric transducer 310 may have a tendency to tilt or bend to one side so that when it is fired, not all of its elongation is in the downward direction; instead, it may extend at an angle. Accordingly, to ensure that the transducers extend straight down, a guide 300 may be included to align and guide the movement of the long stick transducers 310.

As shown in FIG. 3, the feet of the long stick piezo-electric transducers 310 are coupled directly to the diaphragm 325. When a long stick piezo-electric transducer 310 fires, it elongates, pushing up against the mass 315 and down against the foot 320 and the portion of the diaphragm 325 coupled to the foot 320. The guide 300 may include a lubricant 340 between the mass 315 and the edges of each extension portion 305 of the guide 300. The lubricant 340 ensures that the mass is guided in a straight path and minimizes frictional forces created by the transducers rubbing against any extension portion 305 of the guide 300. The lubricant 340 may be any suitable lubricating liquid with a low viscosity and surface tension, for example. The guide 300 may be a block of material, and the extension portions 305 may wrap around each mass in a cylindrical manner. As with the stick transducers of FIGS. 2A–C, when a predetermined voltage is applied to a long stick piezo-electric transducer 310, the long stick piezo-electric transducer 310 elongates, pushing up against the mass 315 and down against the foot 320. Since the foot 320 may be coupled directly to the diaphragm 325, the portion of the diaphragm 325 coupled to the foot 320 may deform, extending down into the ink chamber 330. FIG. 3 also illustrates six ink chamber walls 328. When it has extended into the ink chamber 330, ink may be forced out of the ink chamber 330 and through an orifice 335 below the long stick piezo-electric transducer 310. After the long stick piezo-electric transducer 310 has fired, it returns to its normal length and shape, and the diaphragm 325 therefore also reverts to its normal position. As the diaphragm 325 reverts to its normal position, ink is pulled out of the reservoir and back into the ink chamber 330. Alternatively, the lubricant 340 may not be necessary. For example, in an embodiment the guide 300 may be formed of, or coated with, Teflon or some other low friction material, in which case the lubricant may not be needed.

The size and shape of the masses coupled to the transducers may be dependent upon the system requirements. Also, in an embodiment, the transducers may be utilized without having masses coupled thereto. In such embodiment, the lack of the mass coupled to each transducer may result in a higher drive voltage being necessary when firing a transducer. Additionally, the diaphragm 260 may be formed of an elastic material.

Figure 4:
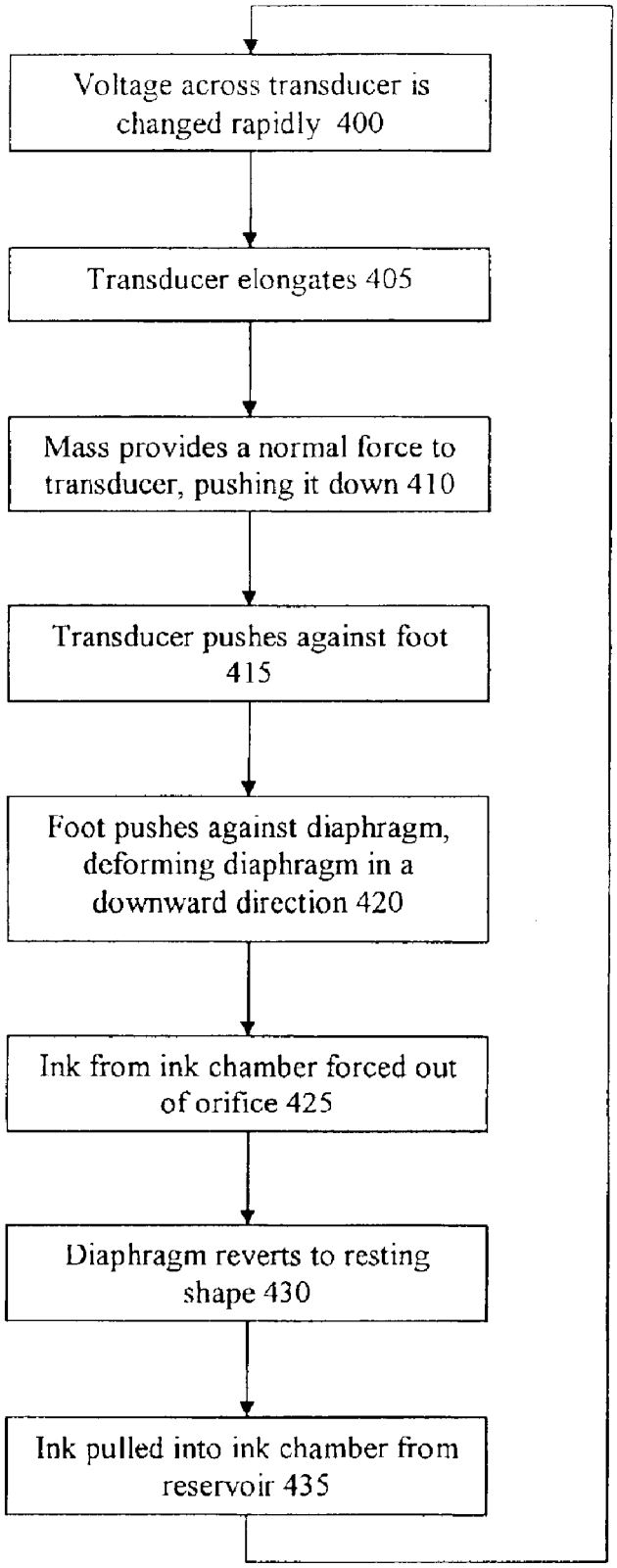
FIG. 4 illustrates a method of operation of a transducer according to an embodiment of the invention.

FIG. 4 illustrates a method of operation of a transducer according to an embodiment of the invention. First, a voltage is applied 400 to a transducer. Next, the transducer elongates 405. A mass coupled to the top end of the transducer (as in FIGS. 2A–C and 3) provides 410 a normal force to the transducer, pushing it in an outward direction. The transducer pushes 415 against a foot coupled to the bottom of the transducer. The foot then pushes 420 down against the diaphragm, deforming the diaphragm 260 in a outward direction. Ink from the ink chamber is then forced 425 out of the orifice. The diaphragm 260 subsequently reverts 430 to its resting shape. Finally, ink is pulled 435 into the ink chamber 272 from the reservoir, and the process repeats at operation 400.

Figure 5:
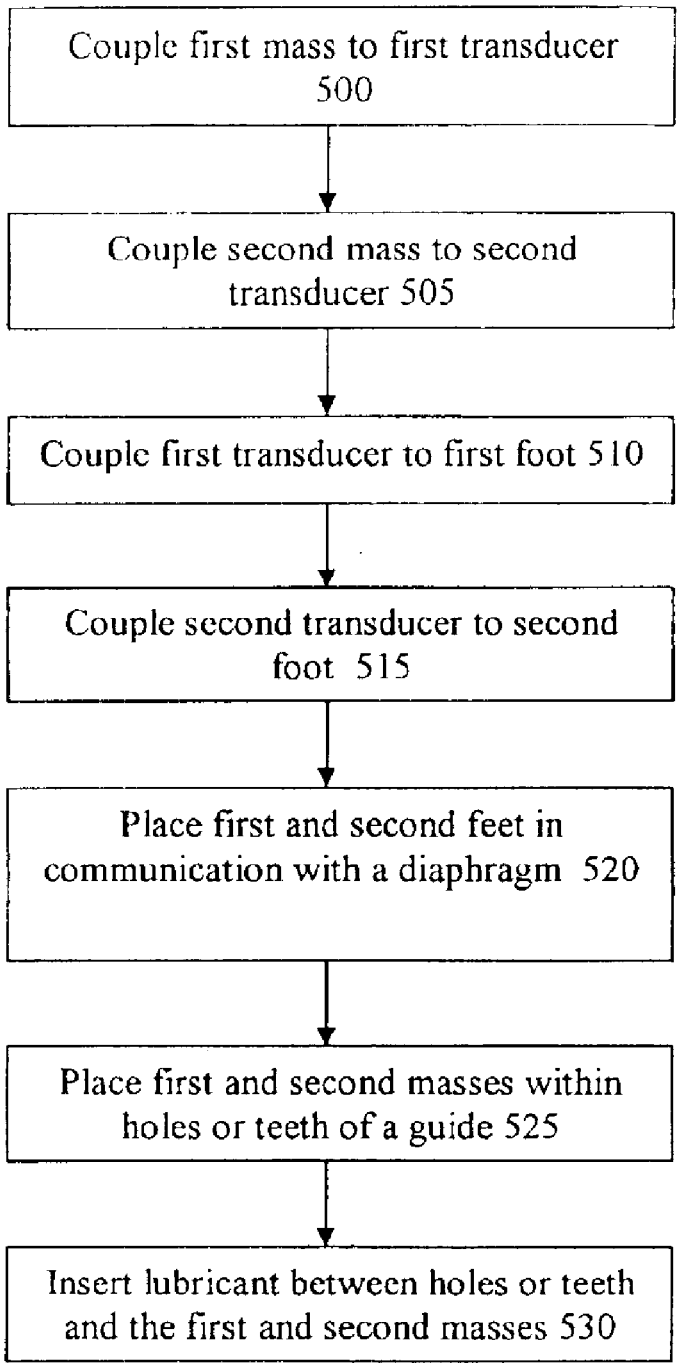
FIG. 5 illustrates a method of forming an inkjet according to an embodiment of the invention.

FIG. 5 illustrates a method of forming an inkjet according to an embodiment of the invention. First, a first mass is coupled 500 to a first transducer. Next, a second mass is coupled 505 to a second transducer. The first mass may be physically separate from the second mass. The first transducer may then be coupled 510 to a first foot, and the second transducer may be coupled 515 to a second foot. Next, the first foot and the second foot may be placed 520 in communication with a diaphragm. The first transducer and the second transducer may be short stack transducers, or long stick transducers, for example. In an embodiment having longer stick transducers, the first mass and the second mass may be placed 525 within extension portions 305 of a guide. Finally, a lubricant may be inserted 530 between the extension portions 305 and each of the first mass and the second mass, but may not be necessary, depending on the system requirements. Also, in some embodiments, a mass need not be coupled to each of the transducers.

An alternative way of forming an ink jet according to an embodiment of the invention may be to construct all of the masses and the piezo-electric material for the transducers as a solid block bonded by a removable material such as wax to a temporary holding plate. While on the plate, the mass block and the piezo-electric block may be diced into separate transducers and masses. The whole diced assembly may then be bonded to the feet on the diaphragm and the holding plate by removing (e.g., melting) the removable material (e.g., wax). Other variations of this alternative method of manufacture designed to expedite assembly and allow for precise positioning of the parts may also be employed. Such methods may be well-known n the manufacturing art.

In the manufacture of a rod expander ink jet, a critical dimension which has to be held to close tolerances is the location of the foot upon the diaphragm. In an embodiment, the foot may be manufactured as part of the diaphragm. This may be implemented by a photo-chemical process (e.g., etching or electroforming) so that the location is very precise. The position of the transducer on the foot in less critical, however. The assembly of an ink jet made with a diaphragm with integral feet may be made easier when it is not required to bond the transducers to a common structure.

The embodiments described above with respect to, e.g., FIGS. 2A–5 are "fill-before-fire" systems, in which the ink chamber contains ink before a firing transducer is fired, pushing against the ink chamber 272, ejecting ink. After firing, when the transducer shortens toward its resting position and length, additional ink is sucked back into the ink chamber. However, additional embodiments may also include "fill-after-fire" systems, where the ink chamber 272 is empty until firing of a transducer, at which point the transducer moves, sucking ink into the chamber, which is then ejected out onto the paper.

While the description above refers to particular embodiments of the present invention, it will be understood that many modifications may be made without departing from the spirit thereof The accompanying claims are intended to cover such modifications as would fall within the true scope and spirit of the present invention. The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A piezo-electric printing system, comprising:

an array of transducers, including at least a first transducer and a second transducer, wherein the first transducer is coupled to a first foot at a first end and is coupled to a first mass at a second end of the first transducer, and elongates in response to a first stimulus, causing ink to eject from a first ink chamber, and the second transducer is coupled to a second foot at a first end and is coupled to a second mass at a second end of the second transducer, and elongates in response to a second stimulus, causing ink to eject from a second ink chamber and the first foot of the first transducer and the second foot of the second transducer are coupled to a movable elastic element, wherein the first transducer and the second transducer are not coupled to a common transducer support structure except where the first foot and second foot are coupled to the movable elastic element.

2. The piezo-electric printing system of claim 1, wherein the first mass is mechanically isolated from the second mass.

3. The piezo-electric printing system of claim 1, wherein the movable elastic element is a diaphragm.

4. The piezo-electric printing system of claim 1, wherein at least one of the first stimulus and the second stimulus is an application of a voltage.

5. The piezo-electric printing system of claim 1, wherein a diaphragm is deformed by at least one of the first foot when the first transducer elongates, and the second foot when the second transducer elongates.

6. The piezo-electric printing system of claim 1, further including a guide to direct movement of the array of transducers.

7. The piezo-electric printing system of claim 6, wherein a lubricant lies between the guide and each of the first transducer and the second transducer.

8. The piezo-electric printing system of claim 6, wherein the guide includes a plurality of extension portions.

9. The piezo-electric printing system of claim 6, wherein the guide is coated with a low friction material.

10. The piezo-electric printing system of claim 9, wherein the low friction material is Teflon.

11. The piezo-electric printing system of claim 6, wherein the guide is formed of a low friction material.

12. The piezo-electric printing system of claim 11, wherein the low friction material is Teflon.

13. The piezo-electric printing system of claim 1, the first transducer and the second transducer being insensitive to temperature fluctuations.

14. A method of forming a piezo-electric printing system, comprising:

coupling a first transducer to a first foot at a first end and at a second end to a mass, wherein the first transducer elongates in response to a first stimulus, causing ink to eject from a first ink chamber; and coupling a second transducer to a second foot at a first end and at a second end to a second mass, wherein the second transducer elongates in response to a second stimulus, causing the ink to eject from a second ink chamber, and the first foot of the first transducer and the second foot of the second transducer are coupled to a movable elastic element, wherein the first transducer and the second transducer are not connected to a common transducer support structure except where the first foot and the second foot are coupled to the movable elastic element.

15. The method of claim 14, wherein the first mass is mechanically isolated from the second mass.

16. The method of claim 14, wherein the movable elastic element is a diaphragm.

17. The method of claim 16, wherein the diaphragm is deformed by at least one of the first foot when the first transducer elongates, and the second foot when the second transducer elongates.

18. The method of claim 14, wherein at least one of the first stimulus and the second stimulus is an application of a voltage.

19. The method of claim 14, further including coupling a guide to the first transducer and the second transducer, wherein the guide is utilized to guide a movement of the array of transducers.

20. The method of claim 19, further including placing a lubricant between the guide and each of the first transducer and the second transducer.

21. The method of claim 19, wherein the guide includes a plurality extension portions.

22. The method of claim 19, wherein the guide is coated with a low friction material.

23. The method of claim 22, wherein the low friction material is Teflon.

24. The method of claim 19, wherein the guide is formed of a low friction material.

25. The method of claim 24, wherein the low friction material is Teflon.

26. The method of claim 14, the first transducer and the second transducer being insensitive to temperature fluctuations.

27. A method of piezo-electric printing, comprising:

applying a first stimulus to a first transducer to cause ink to eject from a first ink chamber, wherein the first transducer is coupled to a first foot at a first end and is coupled to a first mass at a second end, and the first transducer elongates in response to a first stimulus; and applying a second stimulus to a second transducer to cause ink to eject from a second ink chamber, wherein the second transducer is coupled to a second foot at a first end and is coupled to a second mass at a second end, and the second transducer elongates in response to a second stimulus, wherein the first foot of the first transducer and the second foot of the second transducer are coupled to a movable elastic element and the first transducer and the second transducer are not coupled to a common transducer support structure except where the first foot and the second foot are coupled to the movable elastic element.

28. The method of claim 27, wherein the first mass is mechanically isolated from the second mass.

29. The method of claim 27, wherein the movable elastic element is a diaphragm.

30. The method of claim 27, wherein at least one of the first stimulus and the second stimulus is an application of a voltage.

31. The method of claim 27, the first transducer and the second transducer being insensitive to temperature fluctuations.

32. A piezo-electric printing system, comprising:

an array of transducers, including at least a first transducer and a second transducer, wherein the first transducer is coupled to a first foot at a first end and is coupled to a first mass at a second end, and elongates in response to a first stimulus, causing ink to eject from a first ink chamber, and the second transducer is coupled to a second foot at a first end and is coupled to a second mass at a second end, and elongates in response to a second stimulus, causing ink to eject from a second ink chamber, wherein the first foot and the second foot are coupled to a movable elastic element and when the first transducer elongates in response to the first stimulus, the first transducer does not push against a common transducer support structure that is connected to the second transducer.

* * * * *